US005923123A

United States Patent [19]

Suzuki et al.

[11] Patent Number: 5,923,123

[45] Date of Patent: Jul. 13, 1999

[54] ELECTRON GUN ASSEMBLY FOR CATHODE RAY TUBE WITH A VOLTAGE STABILIZING SUPPRESSOR RING

[75] Inventors: Fumihito Suzuki, Fukaya; Takahiro Hasegawa, Gyoda; Shigeru Sugawara, Saitama-ken; Junichi Kimiya, Fukaya, all of Japan

[73] Assignee: Kabushiki Kaisha Toshiba, Kawasaki, Japan

[21] Appl. No.: 08/863,888

[22] Filed: May 28, 1997

[30] Foreign Application Priority Data

May 28, 1996 [JP] Japan ..... 8-133169

[51] Int. Cl.[6] ..... H01J 29/96

[52] U.S. Cl. ..... 315/3; 315/85; 315/382; 313/414

[58] Field of Search ..... 315/3, 85, 382, 315/382.1; 313/414; 348/806

[56] References Cited

U.S. PATENT DOCUMENTS

| | | | |
|---|---|---|---|
| 4,338,543 | 7/1982 | Handel | 313/457 |
| 4,366,415 | 12/1982 | Takenaka et al. | 313/457 |
| 5,519,290 | 5/1996 | Sugawara et al. | 315/382.1 |

FOREIGN PATENT DOCUMENTS

| | | |
|---|---|---|
| 0 332 469 | 9/1989 | European Pat. Off. . |
| 0 367 250 | 5/1990 | European Pat. Off. . |
| 1-232643 | 9/1989 | Japan . |
| 2-223136 | 9/1990 | Japan . |
| 4-322039 | 11/1992 | Japan . |
| 8-102265 | 4/1996 | Japan . |

OTHER PUBLICATIONS

Ichimura Kazuyoshi, "Cathode Ray Tube", European Patent Office Patent Abstracts of Japan, Publ. No. 57119437, Jul. 24, 1982.

Kimura Masamichi, "Cathode Ray Tube Manufacturing Method", European Patent Office Patent Abstracts of Japan, Publ. No. 58198819, Nov. 18, 1983.

*Primary Examiner*—Robert Pascal
*Assistant Examiner*—Justin P. Bettendorf
*Attorney, Agent, or Firm*—Pillsbury Madison & Sutro LLP

[57] ABSTRACT

The electron gun assembly for cathode ray tube, has the structure in which the first, second and third grids are arranged in the traveling direction of an electron beam emitted from cathodes, and so is the fourth grid to which a anode voltage is applied, a suppressing ring is provided to be adjacent to the second and third grids, a dynamic focus voltage which is varied in synchronism with the deflection of the electron beam is applied to the first and third grids, and the first and second grids are connected to each other by means of the resistor provided adjacent thereto.

6 Claims, 3 Drawing Sheets

ELECTRON GUN ASSEMBLY FOR CATHODE RAY TUBE WITH A VOLTAGE STABILIZING SUPPRESSOR RING

BACKGROUND OF THE INVENTION

The present invention relates to an electron gun assembly for a cathode ray tube, used in a color image receiving tube (television picture tube), and more specifically, to an improved structure of an electron gun assembly for a cathode ray tube.

In general, a color image receiving tube has, as shown in FIG. 1, an outer enclosure consisting of a panel 1 and a funnel 2. On the inner surface of the panel 1, a phosphorous screen made of three-color phosphorous layers which emit blue, green and red light rays, namely, a target 3 is formed. A shadow mask 4 is provided on a further inner side of the panel, so as to face the phosphorous screen 3. Also, an electron gun assembly 7 for emitting three types of electron beams 6B, 6G and 6R is provided in a neck 5 of the funnel 2. In the tube, as three electron beams 6B, 6G and 6R emitted from the electron gun are deflected by vertical and horizontal deflecting magnetic fields which are generated by a deflecting device 8 mounted on an outer side of the funnel 2, the phosphorous screen 3 is scanned vertically and horizontally by these three electron beams 6B, 6G and 6R via a shadow mask 4, thus displaying a color image.

In connection with the color image receiving tube described above, the self-convergence-inline type color image receiving tube is widely used in practice. The color image receiving tube of this type has the following structure. That is, an inline type electron gun assembly is employed, and which emits three electron beams 6B, 6G and 6R arranged in a line, which are specifically, a center beam 6G and a pair of side beams 6B and 6R running on the same horizontal plane. These three electron beams 6B, 6G and 6R arranged in the line are deflected by a pin-cushion shaped horizontal deflection magnetic field and a barrel shaped vertical deflection magnetic field, which are generated by a deflection device 8 to which a deflection signals is supplied from a deflection unit (not shown). Therefore, the three electron beams 6B, 6G and 6R can be converged without providing a special converging device.

However, in connection with the self-convergence inline type color image receiving tube, the vertical and horizontal deflection magnetic fields generated by the deflection device 8 have pin-cushion shape and barrel shape, respectively, which are not uniform within themselves. As a result, the three electron beams 6B, 6G and 6R are affected by these non-uniform magnetic fields to create astigmatism, and therefore at the peripheral portion of the screen, they are strongly converged in the vertical direction. Consequently, at the peripheral portion of the screen, the beam spot is made to have an elliptical shape elongated in the horizontal direction, including a core portion having a high luminance and a halo portion having a low luminance located in the vertical direction to the core portion. Such a phenomenon deteriorates the resolution at the peripheral portion of the screen.

As a solution to the deterioration in the resolution at the peripheral portion of the screen, an electron gun assembly of the dynamic focus type, has been proposed, which has a structure in which quadruple-pole lens is formed in the main electron lens unit for focusing an electron beam. In this electron gun assembly, an electron beam generating unit, a quadruple-pole electron lens and an ultimate focusing lens are formed in the order in the traveling direction of the electron beams, that is, along the direction from the cathodes towards the phosphorous screen. With this structure, a dynamic focus voltage which varies in synchronism with the deflection of the electron beam, is supplied to an opposite electrode which constitute the quadruple-pole lens. Thus, the electron beams traveling towards at the peripheral portion of the screen are diverged in the vertical direction, and converged in the horizontal direction. Further, the horizontal- and vertical-directional focusing effect of the ultimate focusing lens is weakened, thus suppressing the deterioration in the resolution at the peripheral portion of the screen. The electron gun assembly of this type entails the problem of a withstanding voltage of the voltage supply unit since two types of medium voltages must be supplied to the opposite electrode from an external device in the quadruple-pole lens.

Jnp. Pat. Appln. KOKAI Publication No. 1-232643 and U.S. Pat. No. 4,945,284 each provide a solution to the above-stated problem, and they disclose an electron gun assembly having the following structure such as shown in FIG. 2. That is, the electron gun assembly has cathodes K, and first to seventh grids G1 to G7 which are arranged in the order from the cathodes K towards the phosphorous screen. Further, a resistor 10 is provided adjacent to the fifth and sixth grids G5 and G6 which constitute a quadruple-pole lens QL, so as to connect the fifth and sixth grids G5 and G6 via the resistor 10, thus supplying a voltage to the fifth grid G5 via the resistor 10.

However, the cathode ray tube having the above-described structure entails the following problem. That is, in the color image receiving tube shown in FIGS. 1 and 2, a anode voltage of 23 to 35 kV is supplied to the seventh grid G7 via a conductive film 12 applied on over an area from an inner surface of a portion of the funnel 2, having a larger diameter, to an inner surface of the adjacent portion to the neck 5, a valve spacer 13 brought into elastically contact with the conductive film 12 and a shield cup C. A focusing potential, which is about 20 to 35% of the anode voltage is applied to the sixth grid G6 via a stem pin 14 which air-tightly pierces through the end portion of the neck 5.

In some cases, the inner surface of the neck 5 is charged under the influence of the conductive film 12, and an electric field emission phenomenon may occur from a grid which constitutes the electron gun assembly. If an electron emission occurs in the sixth grid G6 due to the electric field emission phenomenon, the focusing potential is varied, resulting in that the electron beam is not focused in an optimal fashion. Consequently, the resolution is lowered, and the image quality is deteriorated. Further, a discharge may occur due to the electron emission, and the discharge current or noise thus created may damage the electrical circuit of the cathode ray tube apparatus, or may cause a malfunction of the computer connected thereto.

In order to avoid such a problem, the following measures have proposed. That is, a suppressor ring made of a metal wire is set so as to surround an insulation support rod 16 for fixing the electrodes of the electron gun assembly into an integral body, and then the suppressor ring is evaporated by heat to form a metal deposition film on the inner surface of the neck 5 in a manufacturing step of the color image receiving tube, thereby stabilizing the potential of the inner surface of the neck 5.

However, as can be seen in FIG. 2, with regard to the electron assembly gun having the structure in which a resistor 10 is placed adjacent to the fifth and sixth grids G5 and G6, it is sometimes very difficult to dispose the suppressor ring at an effective position.

More specifically, in the case where the suppressor ring is placed between the terminal 17*a* of the resistor 10 and the shield cup C, for example the sixth grid G6, the metal deposition film is formed adjacent to the conductive film 12, and therefore the potential of the inner surface of the neck 5 cannot be decreased. In the case where the suppressor ring is disposed between terminal 17*a* and terminal 17*b* of the resistor 10, parts of the metal deposition film may be attached to the resistor 10 located near-by, which creates a short-circuit between both terminals 17*a* and 17*b* of the resistor 10. For this reason, the suppressor ring cannot be provided at the above positions. On the other hand, in the case where the suppressor ring is provided close to the cathodes K rather than to the resistor 10, the metal deposition film is attached partially onto the inner surface of the neck 5 at a low potential, and therefore the potential of the inner surface of the neck 5 can be stabilized. However, the portion of the inner surface of the neck 5, which is close to the sixth grid G6, is located near the conductive film 12, and therefore the potential cannot be sufficiently lowered. The effect of suppressing the electric field emission from the sixth grid G6, the terminal 17*a* of the resistor 10 connected to the sixth grid G6, or the like, may not become satisfactory.

BRIEF SUMMARY OF THE INVENTION

The object of the present invention is to provide an electron gun assembly which can prevent the deterioration of the image quality and the lowering of the reliability, which may be caused by the electric field emission from a grid or a resistor, and which is capable of constituting a high-quality and high-reliability cathode ray tube.

According to the present invention, there is provided an electron gun assembly for a cathode ray tube, having a main electron lens portion consisting of a plurality of grids for focusing an electron beam on a target, the beam being emitted from an electron beam forming unit consisting of cathodes and a plurality of grids arranged to be adjacent to the cathodes, in which the plurality of grids are fixedly supported with at least two insulation support rod, the main electron lens portion of the electron gun assembly including at least the first, second and third grids all arranged in the target direction, and so being the fourth grid to which a anode voltage is applied, and having the structure in which, of these grids, the second and third grids are located adjacent to each other, a dynamic focus voltage which varies in synchronism with the deflection of the electron beam, is applied to the first and third grids, and the first and second grids are connected to each other by means of a resistor provided close to these grids.

Further, the suppressor is connected to the second grid at a position closer to the third grid rather than to the resistor.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An electron gun assembly according to an embodiment of the present invention will now be described in detail with reference to drawings.

Figure 3:
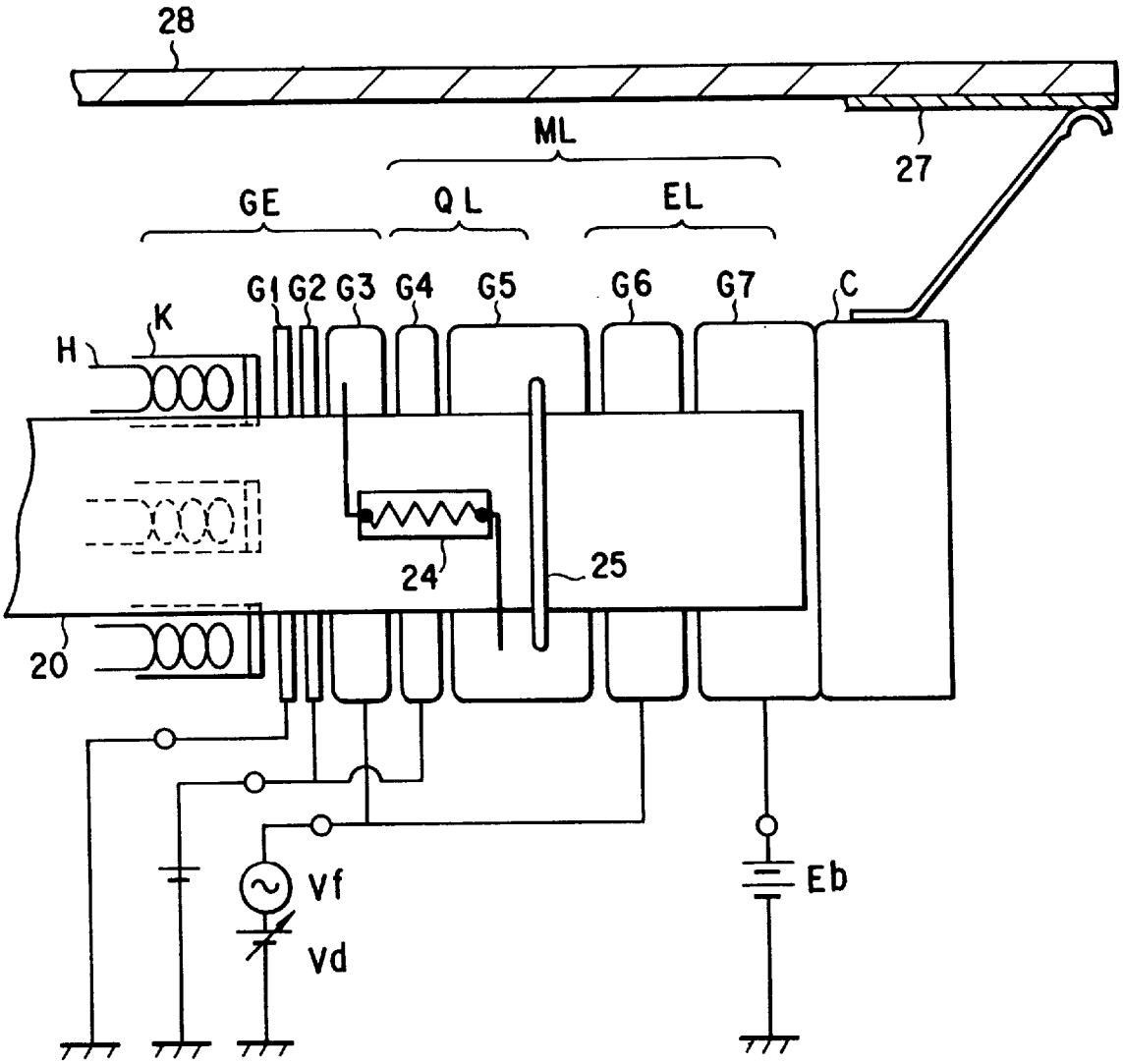
FIG. 3 is a diagram showing the structure of an electron gun assembly for a color image receiving tube, according to an embodiment of the present invention.

FIG. 3 shows an electron gun assembly for color image receiving tube, according to the embodiment. The electron gun assembly includes three cathodes K arranged in a line in a horizontal direction, three heaters H for heating these cathodes K respectively and individually, first to seventh grids G1 to G7 each arranged such as to be a certain distance away from the respective cathode K, in the direction of the phosphorous screen, that is, the target, and a shield cup C mounted to the end of the seventh grid G7, which is on the phosphorous screen side, and the heaters H, cathodes K and the first to seventh grids G1 to G7 are fixedly integrated into one body by means of a pair of insulation support rods 20.

The first and second grids G1 and G2 are made of plate electrodes having an integrated structure, and the third to seventh grids G3 to G7 are made of cylindrical electrodes having an integrated structure.

In each of the first and second grids G1 and G2, three, relatively small, and substantially circular electron beam passing holes, which respectively correspond to three cathodes K, are made in one row.

In a surface of the third grid G3, opposite to the second grid G2, three, larger than those of the second grid G2, and substantially circular electron beam passing holes, which respectively correspond to three cathodes K, are made in one row. Further, in a surface of the third grid G3, opposite to the fourth grid G4, three, larger than those of the second grid G2, and substantially circular electron beam passing holes, which respectively correspond to three cathodes K, are made in one row.

In a surface of the fourth grid G4, opposite to the third and fifth grids G3 and G5, three, same-sized as those of the surface of the third grid G3, opposite to the fourth grid G4, and substantially circular electron beam passing holes, which respectively correspond to three cathodes K, are made in one row.

Figure 1:
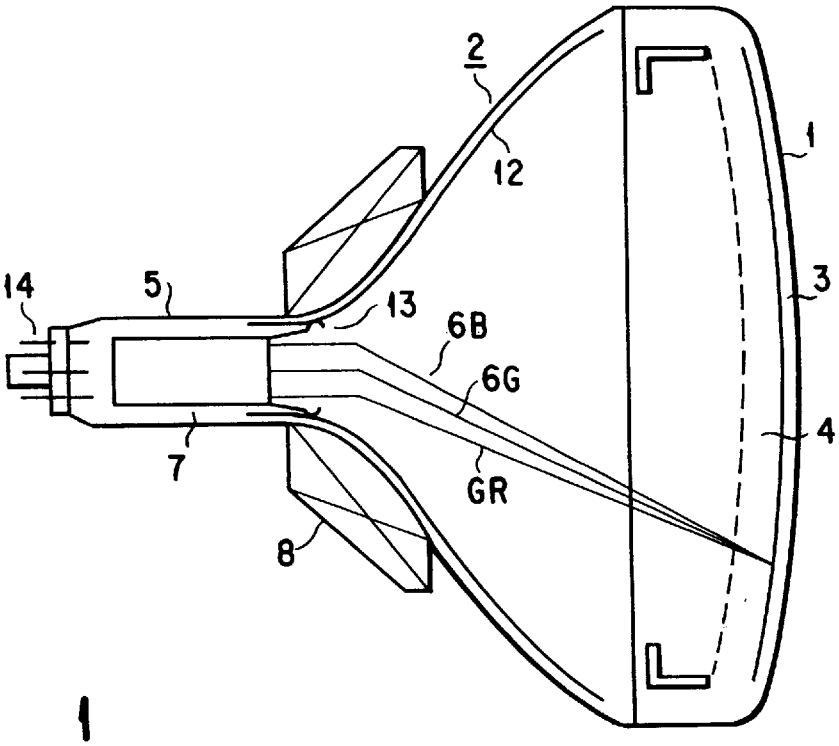
FIG. 1 is a diagram schematically showing the structure of a color image receiving tube.
Figure 4A:
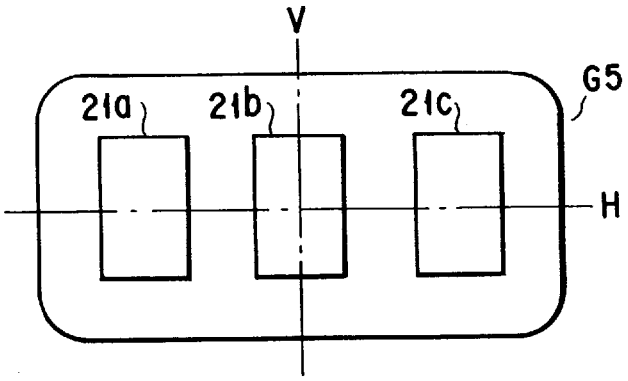
FIG. 4A is a diagram showing the shape of electron beam passage holes of a surface of the fifth grid of the electron gun shown in FIG. 3, which is opposite to the sixth grid.

In a surface of the fifth grid G5, opposite to the fourth grid G4, three, substantially the same-sized as those of the surface of the fourth grid G4, and substantially circular electron beam passing holes, which respectively correspond to three cathodes K, are made in one row. In a surface of the fifth grid G5, opposite to the sixth grid G6, three electron beam passing holes 21*a*, 21*b* and 21*c*, substantially elongated in a vertical direction (V-axis direction), a diameter of which is taken in that direction, and respectively correspond to three cathodes K, are made in one row, as shown in FIG. 4A.

Figure 4B:
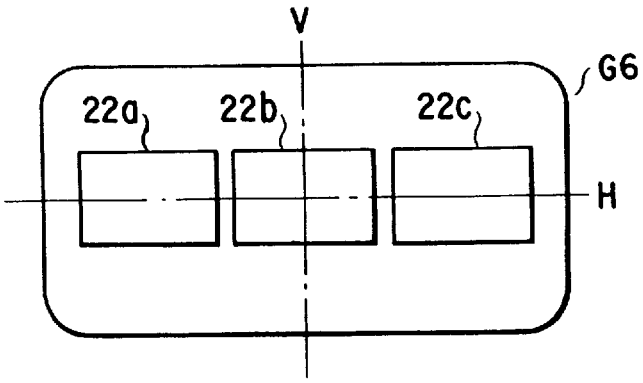
FIG. 4B is a diagram showing the shape of electron beam passage holes of a surface of the sixth grid shown in FIG. 3, which is opposite to the fifth grid.
Figure 2:
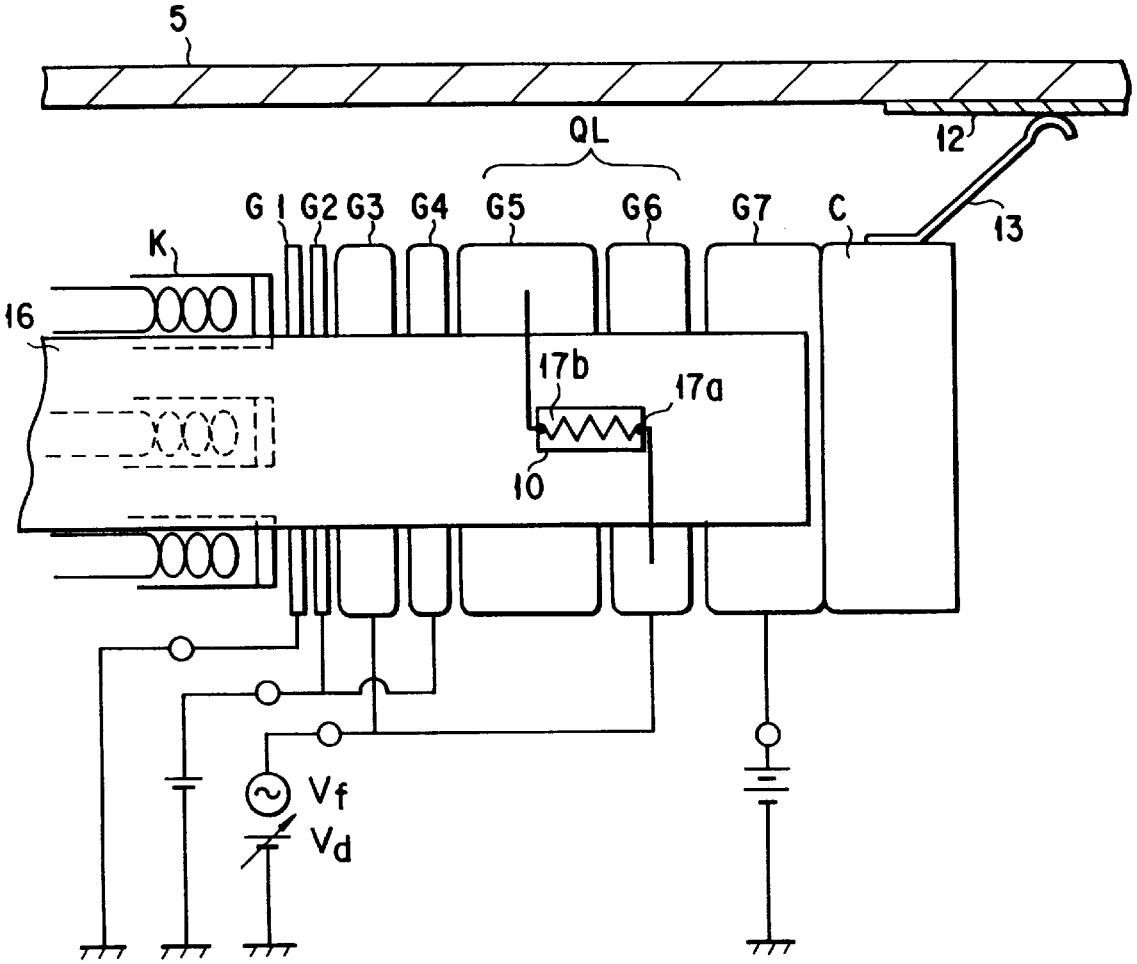
FIG. 2 (PRIOR ART)
FIG. 2 is a diagram showing the structure of a conventional electron gun assembly for a color image receiving tube.

In a surface of the sixth grid G6, opposite to the fifth grid G5, three electron beam passing holes 22*a,* 22*b* and 22*b,* substantially elongated in a horizontal direction (H-axis direction), a diameter of which is taken in that direction, and respectively correspond to three cathodes K, are made in one row, as shown in FIG. 4B. In a surface of the sixth grid G6, opposite to the seventh grid G7, three substantially circular electron beam passing holes having substantially the same size as those of the surface of the fifth grid G5, opposite to the fourth grid G4 are made in one row.

In a surface of the seventh grid G7, opposite to the sixth grid G6 and the shield cup C, three electron beam passing holes having substantially the same size as those of the surface of the sixth grid G6, opposite to the seventh grid G7, and respectively correspond to three cathodes K, are made in one row.

Further, in a bottom portion of the shield cup C, three substantially circular electron beam passing holes having substantially the same size as those of the seventh grid G7 are formed in one row.

In the electron gun assembly of FIG. 3, a resistor 24 is provided near the third and fifth grids G3 and G5, and the third and fifth grids G3 and G5 are connected to each other by means of the resistor 24. Further, a suppressor ring 25 is mounted for the fifth grid G5 to be closer to the phosphorous screen, rather than to the resistor 24.

In the electron gun assembly, a voltage obtained by superimposing a video signal on a DC voltage of 100 to 200V is applied to the cathodes K, and the first grid G1 is grounded. The second grid G2 and the fourth grid G4 are connected to each other within the tube, and a dynamic focus voltage Vd obtained by superimposing a voltage Vf which varies in a parabolic manner, synchronously with the deflection of the electron beam to a DC voltage Vd, which is 20 to 35% of a anode voltage Eb applied to the seventh grid G7, is applied to the third and sixth grids G3 and G6. To the fifth grid G5, at least a DC voltage component of the dynamic focus voltage Vd applied to the third grid G3 is applied via the resistor 24, and due to the static capacitance of the fifth grid G5 and the sixth grid G6, about 50% of the dynamic focus voltage is superimposed. Further, a anode voltage Eb of 25 to 35 kV is applied to the seventh grid G7.

By the application of the above-described voltages, in the electron gun assembly, an electron beam generating unit GE for forming an electron beam by controlling an electron emission from the cathodes K, and acceleration-focusing emitted electrons, is made of the cathodes K and the first to third grids G1 to G3, and a main electron lens unit ML for acceleration-focusing an electron beam generated from the electron beam generating unit GE, onto the phosphorous screen, is made of the third, fourth, fifth, sixth and seventh grids G3, G4, G5, G6 and G7. Particularly, in the main electron lens unit ML, a quadruple-pole lens QL for correcting a deflection aberration, by changing its lens intensity in synchronism with the deflection of the electron beam, is made of the fifth and sixth grids G5 and G6, and an ultimate focusing lens EL for focusing the electron beam ultimately on the phosphorous screen is made of the sixth and seventh grids G6 and G7.

The electron gun assembly having the above-described structure exhibits the following effects.

(a) The third grid G3 and the fifth grid G5 are connected to each other by means of the resistor 24, which is located at a position distant from the conductive film 27 to which a anode voltage Eb is supplied, and therefore the electric field emission from the terminals of the resistor 24 can be reduced.

(b) Since the resistor 24 is connected to both of the third and fifth grids G3 and G5, a suppressor ring 25 can be mounted for the fifth grid G5 which is an electrode, to which a middle voltage is applied, located at a side of the seventh grid G7 to which a higher voltage than that of the resistor 24 is applied. With the suppressor ring 25 provided at the above-mentioned position, a metal deposition film can be formed on the region of the inner surface of the neck 28, which is closer to the seventh grid G7, as well as the region distant from the seventh grid G7, in the case where a metal deposition film is formed on the inner surface of the neck by applying a high-frequency magnetic field on the suppressor ring 25. Consequently, the resistor 24 can be provided at a position where the voltage on the inner surface of the neck is stable, and the electric field emission from the connection portion of the resistor 24 can be further efficiently reduced.

Further, the metal deposition film can be formed at a position distant from the region where the anode voltage is applied, and therefore the leak current can be reduced.

As shown in FIG. 3, in particular, when the suppressor ring 25 is mounted for the fifth grid G5 to which the resistor 24 is connected, the suppressor ring 25 and the resistor 24 can be maintained at the same potential, and thus the leak current between the suppressor ring 25 and the resistor 24 can be prevented.

The above-described embodiment was described in connection with the case of an electron gun assembly of a bipotential type in which the ultimate focusing lens for focusing an electron beam ultimately on the phosphorous screen is symmetrical with respect to its axis; however, the present invention can be applied also to electron gun assembly including other types of symmetrical or asymmetrical lens, or a combination of these lenses.

Further, the quadruple-pole lens is not limited to the type illustrated in FIG. 4.

The present invention can be applied also to electron gun assemblies for cathode ray tube, other than the assembly for the color image receiving tube.

In the case where the main electron lens portion of an electron gun assembly for cathode ray tube is constructed to have a structure including at least the first, second and third grids all arranged in the target direction, and so being the fourth grid to which a anode voltage is applied, in which, of these grids, the second and third grids are located adjacent to each other, a dynamic focus voltage which varies in synchronism with the deflection of the electron beam, is applied to the first and third grids, and the first and second grids are connected to each other by means of a resistor provided close to these grids, the following advantage can be obtained. That is, since the resistor is located at a position distant from the fourth grid G4 to which a anode voltage Eb is applied, and the conductive film on the inner surface of the neck, the electric field emission from the terminals of the resistor can be reduced.

Further, with the structure in which the resistor is connected to the first and second grids, and the suppressor ring is connected closer to the fourth grid rather than to the resistor of the second grid, a metal deposition film can be formed on the region of the inner surface of the neck, which is closer to the fourth grid than to the resistor. Consequently, the resistor can be provided at a position where the voltage on the inner surface of the neck is stable, and the electric field emission from the connection portion of the resistor can be further efficiently reduced.

In particular, when a suppressor ring is mounted for the second grid to which the resistor is connected, the suppressor ring and the resistor can be maintained at the same potential, and thus, for example, the leak current between the suppressor ring and the resistor can be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. An electron gun assembly for a cathode ray tube having a first end and a second end, the electron gun assembly comprising:

a cathode provided in the vicinity of the first end, for emitting an electron beam;

directing means including a number of grids provided adjacent to the cathode, for directing the electron beam towards the second end after the electron beam is emitted from the cathode;

a main electron lens portion for focusing the electron beam from the directing means on a target, the main electron lens portion including first, second and third grids arranged in order along a traveling direction of the electron beam, and a fourth grid for receiving an anode voltage, the second and third grids being arranged adjacent to each other, and the first and third grids arranged to receive the same voltage;

at least two insulation support rods for fixedly supporting all of the grids;

a resistor, provided near the first and second grids, for connecting the first and second grids to each other; and a metal band, provided between the resistor and the second end of the electron gun assembly, for surrounding the at least two insulation support rods, wherein the metal band stabilizes voltages in the vicinity of the directing means and the main electron lens portion.

2. An electron gun assembly according to claim 1, further comprising means for applying a dynamic voltage to the first and third grids.

3. An electron gun assembly according to claim 1, wherein the metal band is located on a side of the second grid, the location being near the vicinity of the fourth grid.

4. An electron gun assembly for a cathode ray tube having a first end and a second end, the electron gun assembly comprising:

a cathode provided in the vicinity of the first end, for emitting an electron beam;

directing means including first, second, and third grids, provided adjacent to the cathode, for directing the electron beam towards the second end after the electron beam is emitted from the cathode;

a main electron lens portion for focusing the electron beam from the directing means on a target, the main electron lens portion including fourth, fifth, and sixth grids arranged in order along a traveling direction of the electron beam, and a seventh grid arranged to receive an anode voltage, the third and sixth grids being arranged to receive the same voltage;

at least two insulation support rods for fixedly supporting all of the grids;

a resistor, provided near the third and fifth grids, for connecting the third and fifth grids to each other; and a metal band, provided between the resistor and the second end of the electron gun assembly, for surrounding the at least two insulation support rods, wherein the metal band stabilizes voltages in the vicinity of the directing means and the main electron lens portion.

5. An electron gun assembly according to claim 4, further comprising means for applying a dynamic voltage to the third and sixth grids.

6. An electron gun assembly according to claim 4, wherein the metal band is located on a side of the fifth grid, the location being near the vicinity of the seventh grid.

* * * * *